US005167543A

United States Patent [19]

Wurster

[11] Patent Number: 5,167,543

[45] Date of Patent: Dec. 1, 1992

[54] MULTIPLE BEAM ELECTRICAL CONNECTOR SOCKET HAVING ANTI-TANGLE SHIELDS

[75] Inventor: Walter W. Wurster, West Covina, Calif.

[73] Assignee: Custom Stamping, Inc., Covina, Calif.

[21] Appl. No.: 763,951

[22] Filed: Sep. 23, 1991

[51] Int. Cl.[5] ..... H01R 11/22

[52] U.S. Cl. ..... 439/851; 439/885; 439/856

[58] Field of Search ..... 439/851–857, 439/861, 862, 842, 843, 886, 81, 82, 885; 29/882, 884

[56] References Cited

U.S. PATENT DOCUMENTS

| | | | |
|---|---|---|---|
| 2,563,760 | 8/1951 | Uline | 439/851 |
| 2,615,951 | 10/1952 | Klostermann | 439/851 |
| 3,605,068 | 9/1971 | Rayburn . | |
| 3,665,378 | 5/1972 | Hammell et al. . | |
| 3,815,081 | 6/1974 | Jones | 439/851 |
| 3,838,388 | 9/1974 | Bauerle et al. . | |
| 3,973,919 | 8/1976 | Simon | 439/885 |
| 4,002,400 | 1/1977 | Evans | 439/851 |
| 4,083,623 | 4/1978 | Lynch | 439/741 |
| 4,159,160 | 6/1979 | Plyler et al. . | |
| 4,390,231 | 6/1983 | Plyler et al. . | |
| 4,521,961 | 6/1985 | Roeschlein . | |
| 4,679,886 | 7/1987 | King . | |
| 4,728,304 | 3/1988 | Fischer . | |
| 4,850,880 | 7/1989 | Zayat, Jr. et al. . | |
| 4,934,967 | 6/1990 | Marks et al. . | |
| 4,981,450 | 1/1991 | Salvatore . | |

*Primary Examiner*—David L. Pirlot

*Attorney, Agent, or Firm*—Spensley Horn Jubas & Lubitz

[57] ABSTRACT

An electrical connector socket in accordance with one specific embodiment of the invention has multiple beams extending forwardly from the forward edge of a barrel portion, the beams converging toward a central longitudinal axis. The beams have forward ends or tips configured to receive and grip a conductor. A shield disposed between adjacent beams and projecting forwardly from the forward edge of the barrel reduces the size of the open area between adjacent beams, thereby preventing tangling of the sockets during tumbling or other processing thereof. Pursuant to alternative embodiments, the side edges of each beam are configured to diverge from the forward edge of the barrel to an intermediate beam section. From there, the side edges converge (or diverge, in accordance with one of the alternative embodiments) toward the tip. In either case, the open area between adjacent beams is reduced sufficiently to prevent tangling of the sockets during processing thereof.

2 Claims, 4 Drawing Sheets

MULTIPLE BEAM ELECTRICAL CONNECTOR SOCKET HAVING ANTI-TANGLE SHIELDS

FIELD OF THE INVENTION

The present invention relates generally to electrical connectors, and more specifically to an improved multiple beam clip or socket having shields preventing tangling of the sockets during fabrication processes involving tumbling of the sockets.

BACKGROUND OF THE INVENTION

Sockets or clips having multiple fingers or beams are commonly used in electrical connectors designed to mate with the pins of integrated circuits and other electronic devices. As is known, such sockets are formed in multi-stage or progressive stamping dies. Following in the stamping process, the sockets are typically tumbled to reduce burrs and to polish and improve the surface finish. The sockets may also be heat treated or plated using a tumbling process.

Although sockets having three fingers or beams are known, many sockets in use today have a greater number of beams, for example, four or six.

Generally speaking, the more beams that a socket has the more costly it is to manufacture and the more difficult it is to control the manufacturing process. Also, sockets with greater numbers of beams tend to result in higher insertion and withdrawal forces during the use of the socket. Such forces can be decreased by controlling beam configuration and material. But this is typically accompanied by a decrease in per beam normal forces because those forces would be distributed over four or six points. Since normal force is a factor determining Hertzian stress, a decrease in normal force results in a reduction of Hertzian stress and therefore in a deterioration of electrical performance, most notably, higher and less stable contact resistance. Thus, additional beams do not necessarily result in better electrical performance.

Moreover, the beams of sockets having, for example, six beams, are more susceptible to failure during the insertion process of pressing the socket into a sleeve. Beams that break off can lodge in between the sleeve and the connecting pin resulting in product failure.

It has been found that sockets employing three beams can provide lower insertion/withdrawal forces while preserving excellent electrical characteristics. Thus, when mated to the round, square or rectangular pins of integrated circuit or pin grid array devices, such three beam sockets create high Hertzian stress connections. Three beam sockets are also less costly to manufacture because the manufacturing process is easier to control. Still further, the beams of three beam sockets are less prone to break off during use.

Nevertheless, existing three beam sockets do have one drawback. The spaces separating the beams of three beam sockets are usually large enough to allow the parts to interlock or tangle during fabrication processes in which the parts are tumbled. Such tangling results when the tip of one socket enters and lodges in the space between adjacent beams of another socket. This not only creates a feeding problem in subsequent assembly processes, but results in a loss of product and production, since it is not economical to untangle the parts. Although tangling can arise with sockets having more than three beams, this is not usually the case because the spaces between the beams of such sockets tend to be smaller.

Thus, it is an overall object of the present invention to provide a multiple beam socket which obviates the problem of interlocking or tangling of the parts during tumbling.

SUMMARY OF THE INVENTION

An electrical connector socket in accordance with one exemplary embodiment of the invention has multiple beams extending forwardly from the forward edge of a barrel portion of the socket. The beams may have substantially identical configurations and may be substantially equiangularly spaced about, and converge toward, a central longitudinal axis. The beams have forward ends or tips configured to receive and grip a conductor such as a round pin or post. A shield disposed between adjacent beams and projecting forwardly from the forward edge of the barrel reduces the size of the open area between adjacent beams thereby preventing tangling of the sockets during tumbling or other processing thereof.

Pursuant to an alternative embodiment, the width of each beam of a three beam socket is so configured that the beam occupies a sufficient portion of the open area between beams to prevent tangling. In accordance with one specific version of this embodiment, the side edges of each beam are configured to diverge from the forward edge of the barrel to a section of maximum width. From there the side edges converge toward the tip. The open area between adjacent beams is thereby reduced sufficiently to prevent tangling of the sockets during processing thereof.

BRIEF DESCRIPTION OF THE DRAWINGS

Further objects, advantages and features of the invention will become apparent from a reading of the detailed description of the preferred embodiments, when taken together with the accompanying drawings in which.

DETAILED DESCRIPTION OF THE PREFERRED EMBODIMENTS

Figure 1:
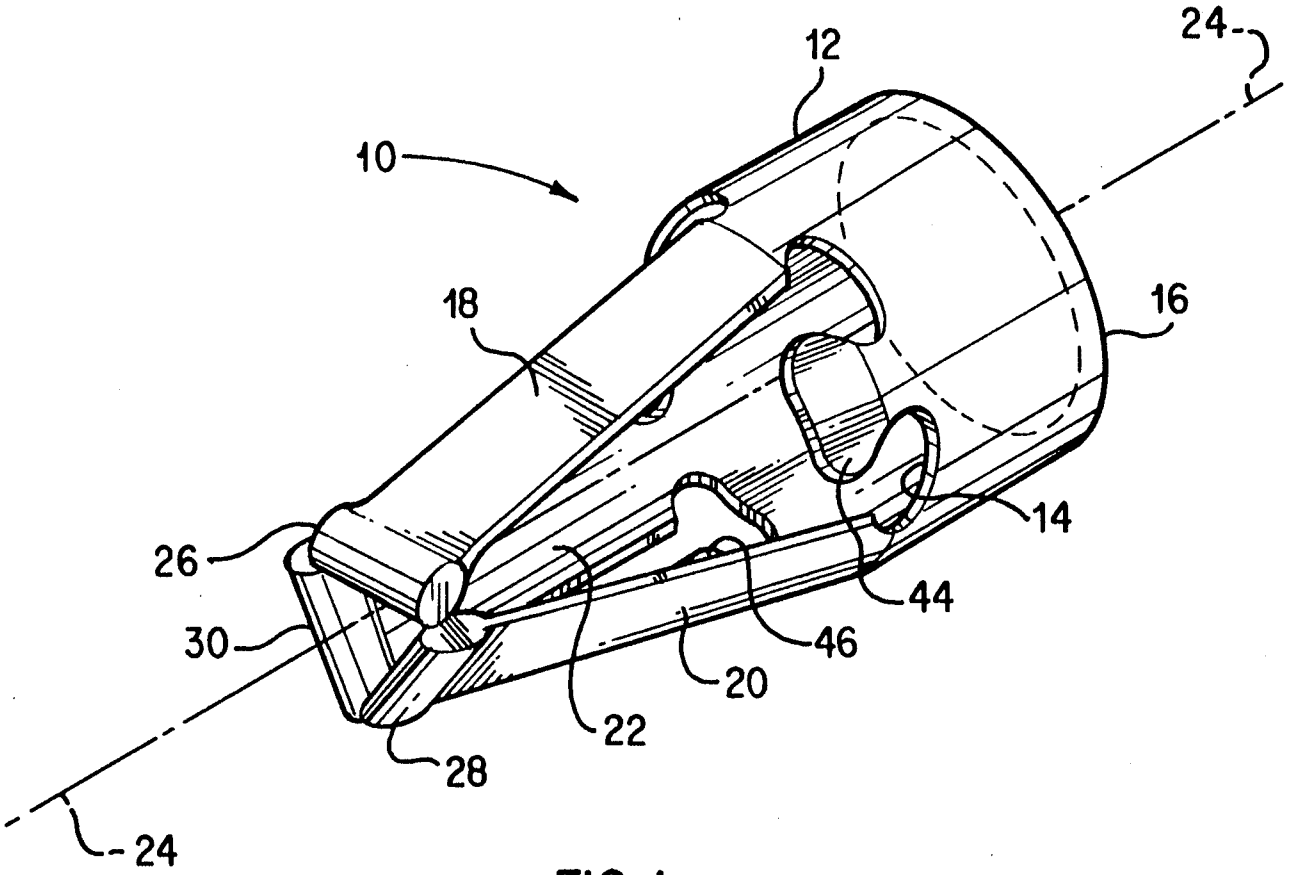
FIG. 1 is a perspective view of a three-finger socket in accordance with a first embodiment of the present invention.
Figure 2:
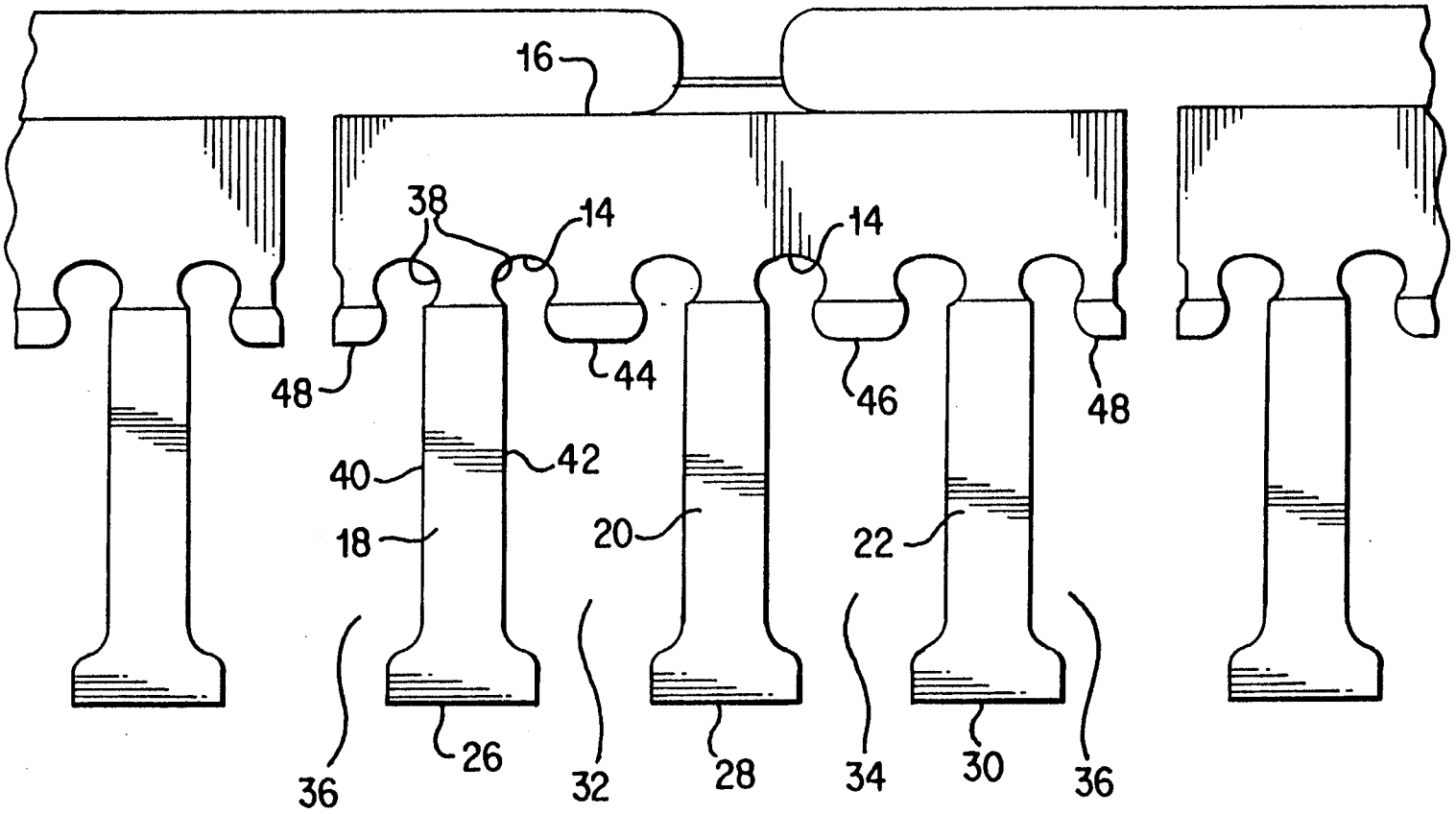
FIG. 2 is a top plan view of a flat pattern of a strip of cut sheet metal from which the socket of FIG. 1 is formed.

Referring to FIGS. 1 and 2, there is shown a three beam clip or socket 10 fabricated from beryllium copper sheet metal or the like, including a barrel portion 12 having a forward edge 14 and a rear edge 16.

Extending forwardly from the forward edge of the barrel 12 are three fingers or beams 18, 20 and 22. The beams are spaced about a central longitudinal axis 24 and converge toward that axis to tips 26, 28 and 30, respectively. The spaces between adjacent fingers are identified by the reference numerals 32, 34 and 36. Although typically the beams 18, 20 and 22 will be substantially identical in configuration and substantially equiangularly spaced about the axis 24, it will be obvious that this need not be the case and that predetermined differences may be built into the geometries of the various beams to achieve particular results in the use of the end product.

The tips 26, 28 and 30 are widened portions of the beam ends configured so that the socket can grip a pin or post of a device such as an integrated circuit package. As is well known, the gripping forces (principally the normal forces) and hence the electrical characteristics of the socket/pin connection are chiefly determined by such factors as beam geometry and material. Thus, for example, portions of the beams may have undercuts 38 where they join the barrel 12.

In the example of FIG. 1, the side edges of the beams, such as the edges 40 and 42 of the beam 18, are substantially linear and parallel.

Also projecting from the forward portion of the barrel between adjacent beams are three anti-tangle shields 44, 46 and 48. The shields are configured to occupy a sufficient portion of the spaces 32, 34 and 36 between adjacent beams so as to prevent the tips of one socket from entering the interbeam spaces of another socket during tumbling or like operations involving part-on-part interaction. Typically, the shields will have substantially identical configurations and be substantially equiangularly spaced.

It has been found that such anti-tangle shields do not degrade the performance of the socket in use, nor is the fabrication process negatively affected.

Figure 3:
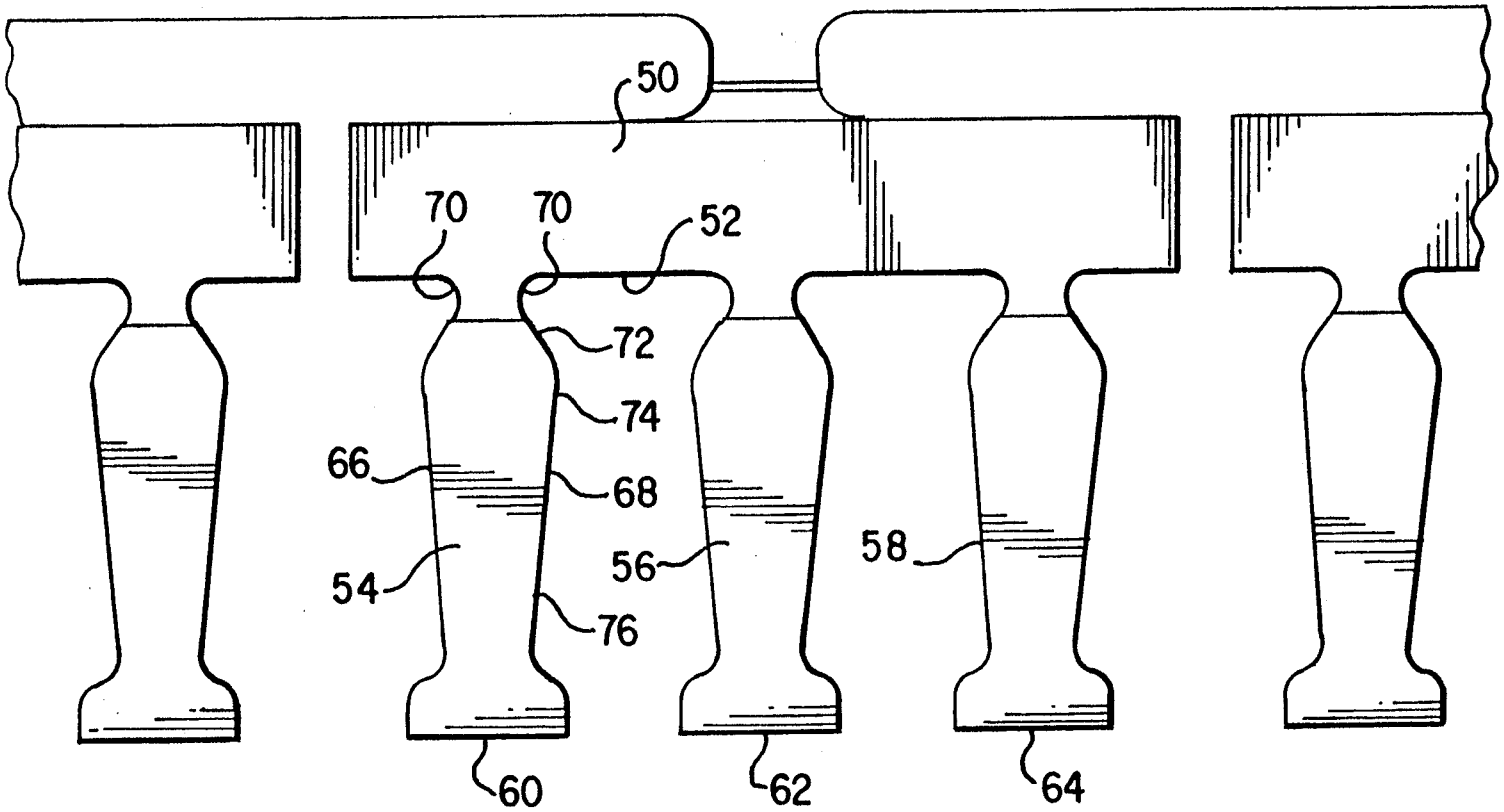
FIGS. 3 and 4 are top plan views of portions of flat patterns of strips of cut sheet metal from which sockets in accordance with two alternative embodiments of the invention may be formed.

FIG. 3 shows a flat sheet metal pattern from which sockets, according to a second embodiment, may be fabricated. In this embodiment, instead of anti-tangle shields projecting from the forward edge portion of the barrel, the edges of the beams themselves are configured to achieve the same result.

The second embodiment includes a barrel portion 50 having a forward edge 52 from which three spaced beams 54, 56 and 58 project as in the first embodiment. Also as in the first embodiment, these beams may be substantially identical in geometry and spacing, and have enlarged tips 60, 62 and 64, respectively. Moreover, the beams are formed so as to converge toward a central longitudinal axis of the final product. With reference to the beam 54 by way of example, this beam includes side edges 66 and 68 and is undercut at 70 where the beam joins the forward edge of the barrel. Moving forwardly from that junction, the edges 66 and 68 of the beam define a first beam section 72 which diverges to an intermediate or second section 74 of maximum beam width. The second section 74 may simply comprise opposed apexes or points. Alternatively, the portions of the edges defining the section 74 may be straight and parallel, or curved, the latter configuration being shown in FIG. 3. The beam edges further include a third section 76 along which the edges 66 and 68 converge toward the tip of the beam. The width of the section of maximum width is sufficient to prevent entry into interbeam spaces of the tips of other sockets during a tumbling or like process.

Figure 4:
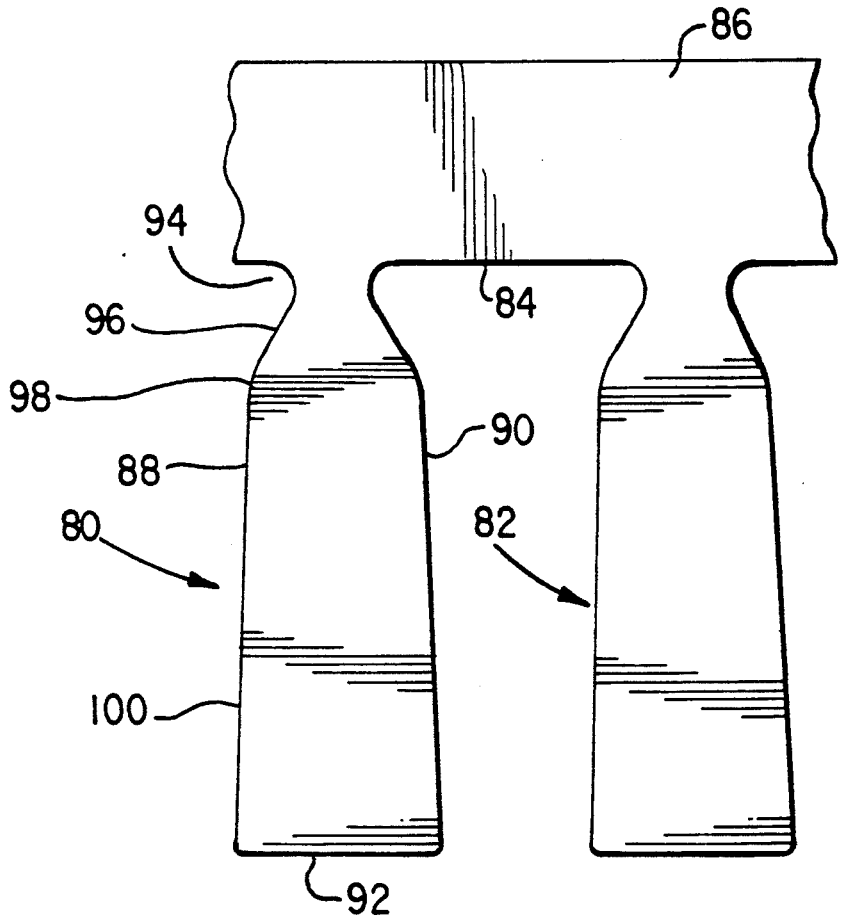

FIG. 4 shows a part of a third embodiment including spaced beams 80 and 82 projecting from the forward edge 84 of a barrel portion 86. Referring to beam 80 as representative, this beam has side edges 88 and 90 and a widened tip 92. As in the second embodiment, the side edges 88 and 90 are undercut at 94 and define a first, diverging beam section 96 and a second or intermediate beam section 98 along which the edges are curved. From there, the edges define a third beam section 100 along which the edges are straight and diverge slightly toward the tip. Again, the width of the beams are sufficient to prevent tangling of the sockets during processing thereof.

It will be obvious to those skilled in the art that many changes and modifications in the preferred embodiments of the invention can be made without departing from the scope of the invention. For example, it will be obvious that many different shield geometries and shapes may be utilized so long as the overall object of reducing the interbeam space and therefore access to those spaces by the tips of other pins, is achieved. Accordingly, the scope of the invention is intended to be limited only by that of the appended claims.

What is claimed is:

1. A low insertion force electrical connector socket comprising:

a generally cylindrical barrel having a longitudinal central axis and forward and rear edges;

three beams extending forwardly from the forward edge of the barrel, the beams being spaced about said axis and converging toward said axis, the beams having forward tips configured to receive and grip a conductor; and a shield disposed between adjacent beams, each shield projecting forwardly from the forward edge of the barrel a portion of the distance to said forward tips, the shields reducing the size of the open area between adjacent beams to less than the size of the forward tips, thereby preventing tangling of the sockets during processing thereof.

2. An electrical connector socket, as defined in claim 1, in which:

the beams are substantially identical in configuration and substantially equiangularly spaced about said axis.

* * * * *